US005725684A

United States Patent [19]

Inoue et al.

[11] Patent Number: 5,725,684

[45] Date of Patent: Mar. 10, 1998

[54] AMORPHOUS HARD MAGNETIC ALLOY, AMORPHOUS HARD MAGNETIC CAST ALLOY, AND METHOD FOR PRODUCING THE SAME

[75] Inventors: Akihisa Inoue, 1-7 Yukigaya, Otsuka-cho, Ota-ku, Tokyo; Tao Zhang; Akira Takeuchi, both of Miyagi-ken, all of Japan

[73] Assignees: Alps Electric Co., Ltd.; Akihisa Inoue, both of Tokyo, Japan

[21] Appl. No.: 753,863

[22] Filed: Dec. 3, 1996

[30] Foreign Application Priority Data

Dec. 8, 1995 [JP] Japan ..... 7-320897

[51] Int. Cl.[6] ..... H01F 1/153

[52] U.S. Cl. ..... 148/304; 148/100; 148/538

[58] Field of Search ..... 148/304, 403, 148/538, 100

[56] References Cited

U.S. PATENT DOCUMENTS 4,374,665 2/1983 Koon ..... 148/403
4,859,256 8/1989 Sawa et al. ..... 148/304

FOREIGN PATENT DOCUMENTS 57-57854 4/1982 Japan ..... 148/304
61-15942 1/1986 Japan ..... 148/304

*Primary Examiner*—John Sheehan
*Attorney, Agent, or Firm*—Guy W. Shoup

[57] ABSTRACT

It is an object of the present invention to provide an amorphous hard magnetic alloy which can be produced by a casting method having a low cooling rate and has a large thickness not achieved by conventional liquid quenching methods, an amorphous hard magnetic casting alloy and a method for producing the amorphous hard magnetic cast alloy.

An amorphous hard magnetic alloy in accordance with the present invention has the following general formula:

$$A_x—(Fe_{1-a}Co_a)_y—D_z$$

wherein A represents at least one element selected from the group consisting of Nd, Sm, Pr and Pm; D represents at least one element selected from the group consisting of Al, Ga, and Ge; suffixes x, y, and z satisfy $50 \leqq x \leqq 75$, $10 \leqq y \leqq 45$, and $5 \leqq z \leqq 15$ atomic percent, and suffix a satisfies $0 \leqq a \leqq 0.5$.

12 Claims, 18 Drawing Sheets

AMORPHOUS HARD MAGNETIC ALLOY, AMORPHOUS HARD MAGNETIC CAST ALLOY, AND METHOD FOR PRODUCING THE SAME

BACKGROUND OF THE INVENTION

1. Field of the Invention

The present invention relates to an amorphous hard magnetic alloy which can be produced by casting and exhibits high coercive force, an amorphous hard magnetic casting alloy and a method for producing the amorphous hard magnetic casting alloy.

2. Description of the Related Art

The development of amorphous alloys which can be produced in large sizes with the lower cooling rates of oxide glasses, have been a great issue in the fields of material science and technology.

Many amorphous alloys have been produced using liquid quenching methods based on such a background. However, most of these amorphous alloys have critical cooling rates of $10^4$ K/sec. or more for forming amorphous glass phases. Further, most of the resulting amorphous alloys are thin ribbons or wires each having a thickness of 0.2 mm or less, or powder having a particle size of 50 μm or less.

A La—Al—Cu-based amorphous bulk alloy having a thickness of approximately 7 mm was first produced by casting in 1989. Since then several other alloys which can be produced by casting have been discovered in La—Al—TM-based, Mg—La—TM based, Zr—Al—TM-based, Ti—Zr—Al—Tm—Be-Based, and Ti—Zr—TM—Be-based alloys, wherein La is a rare earth metal, and TM is a transition metal.

These amorphous alloys have critical cooling rates of $10^2$ K/sec. or less and can be conventionally cast using copper molds. Further, amorphous bulk alloys, having extremely low critical cooling rates of around 1.5 K/sec., can be produced by arc melting or water quenching, and having large diameters of 10 mm or more, have been discovered.

In consideration of such circumstances, the present inventors have investigated amorphous bulk alloys containing iron, i.e., Fe-based alloys containing a first additive element, such as Al or Ga, and a second additive element, such as P, C, B, or Ge, and have discovered an amorphous bulk alloy (metal glass) which can be produced by casting and has hard magnetism, and have thus achieved the present invention.

SUMMARY OF THE INVENTION

It is an object of the present invention to provide an amorphous hard magnetic alloy which can be produced by a casting method having a low cooling rate unlike a liquid quenching method and has a large thickness not achieved by conventional liquid quenching methods, an amorphous hard magnetic casting alloy and a method for producing the amorphous hard magnetic cast alloy.

An amorphous hard magnetic alloy in accordance with a first aspect of the present invention has the following general formula:

$$A_x—(Fe_{1-a}Co_a)_y—D_z$$

wherein A represents at least one element selected from the group consisting of Nd, Sm, Pr and Pm; D represents at least one element selected from the group consisting of Al, Ga, and Ge; suffixes x, y, and z satisfy $50 \leqq x \leqq 75$, $10 \leqq y \leqq 45$ and $5 \leqq z \leqq 15$ atomic percent, and suffix a satisfies $0 \leqq a \leqq 0.5$.

Preferably, the suffix y may satisfies $25 \leqq y \leqq 35$ atomic percent.

Preferably, random anisotropic ferromagnetic clusters may form in the alloy.

An amorphous hard magnetic cast alloy in accordance with a second aspect of the present invention comprises the amorphous hard magnetic alloy set forth above.

A method for producing an amorphous hard magnetic cast alloy in accordance with a third aspect of the present invention comprises: casting a melt of an amorphous hard magnetic alloy comprising a composition of the following formula into a mold followed by cooling:

$$A_x—(Fe_{1-a}Co_a)_y—D_z$$

wherein A represents at least one element selected from the group consisting of Nd, Sm, Pr and Pm; D represents at least one element selected from the group consisting of Al, Ga, and Ge; suffixes x, y, and z satisfy $50 \leqq x \leqq 75$, $10 \leqq y \leqq 45$, and $5 \leqq z \leqq 15$, and suffix a satisfies $0 \leqq a \leqq 0.5$ atomic percent.

Preferably, the amorphous hard magnetic cast alloy may be produced by injection casting in which the melt reserved in a crucible is cast from an injection nozzle into a cavity of the mold by applying pressure onto the melt.

Preferably, the suffix y may satisfy $25 \leqq y \leqq 35$ atomic percent.

BRIEF DESCRIPTION OF THE DRAWINGS

FIG. 6A and 6B are diagrams illustrating diffraction patterns of different microstructures by energy dispersive X-ray (EDX) spectroscopy, wherein FIG. 6A shows a diffraction pattern at a region of the plain microstructure not including a needle-like microstructure, and FIG. 6B shows a diffraction pattern at a region including a needle-like microstructure;

FIG. 11A to 11D are graphs illustrating the Fe content vs magnetic properties of an alloy in accordance with the present invention, wherein FIG. 11A is a graph illustrating the Fe content vs residual magnetization, FIG. 11B is a graph illustrating the Fe content vs coercive force, FIG. 11C is a graph illustrating the Fe content vs maximum energy product, and FIG. 11D is a graph illustrating the Fe content vs magnetization;

FIG. 14A and 14B are graphs illustrating the annealing temperature vs magnetic properties of an alloy in accordance with the present invention, wherein FIG. 14A is a graph illustrating the annealing temperature vs residual magnetization, and FIG. 14B is a graph illustrating the annealing temperature vs coercive force;

DESCRIPTION OF THE PREFERRED EMBODIMENTS

Figure 1:
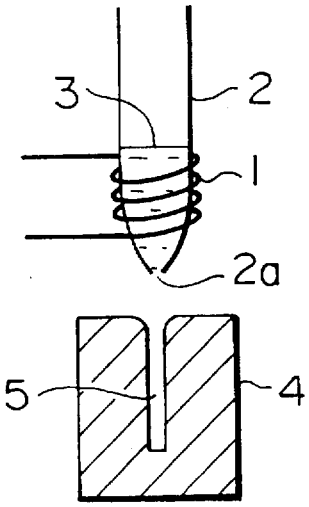
FIG. 1 is a cross-section view of an embodiment of a casting apparatus for producing an amorphous hard magnetic casting alloy in accordance with the present invention.

The present invention will now be illustrated with reference to the drawings.

An amorphous hard magnetic alloy in accordance with the present invention comprises a rare earth element such as Sm, Pr, or Pm as a primary component, a predetermined amount of Fe, and an additional element, such as Ga, Ge or Al. Such an amorphous hard magnetic alloy can be expressed by the following general formula:

$$A_x—(Fe_{1-a}Co_a)_y—D_z$$

wherein A represents at least one element selected from the group consisting of Nd, Sm, Pr and Pm; D represents at least one element selected from the group consisting of Al, Ga and Ge; suffixes x, y, and z preferably satisfy $50 \leqq x \leqq 75$, $10 \leqq y \leqq 45$ and $5 \leqq z \leqq 15$ atomic percent, and suffix a satisfies $0 \leqq a \leqq 0.5$. It is more preferable that suffix y satisfies $25 \leqq y \leqq 35$.

Basis of the limitation of the alloy composition

In order to produce an amorphous phase alloy by casting in accordance with the present invention, the Fe content may basically range from 0 to 90 atomic percent and the D content may range from 0 to 93 atomic percent. The cooling rate of the melt is restricted by the diameter of the cast alloy in conventional casting methods. In detail, the cooling rate increases with increasing diameter of the cast alloy.

In an alloy composition in accordance with the present invention, an amorphous phase forms at an extremely low cooling speed of several K/sec. to several dozen K/sec. when compared with cooling speeds which can be achieved with conventional liquid quenching methods. The Fe content preferably ranges from 10 to 45 atomic percent in order to reproducibly form an amorphous phase in a practical bulk alloy having a diameter of approximately 1 to 10 mm. When the Fe content exceeds this range, the crystal phase content increases or dominates.

Since the maximum energy product value is maximized at an Fe content of approximately 30 atomic percent within the range of the Fe content set forth above, the Fe content preferably ranges from 20 to 40 atomic percent, and more preferably from 25 to 35 atomic percent.

A part of Fe may be replaced with Co in the alloy composition in accordance with the present invention. Since Co having large crystal magnetic anisotropy enhances hard magnetism and increases saturation magnetization in crystalline alloys, it will reveal the same effects in the alloy including ferromagnetic clusters in accordance with the present invention. Satisfactory hard magnetism can be achieved by replacing 50 percent or less of Fe with Co. A replacement of over 50 percent causes a decrease in hard magnetism. Thus, it is preferable that 50 percent or less of Fe is replaced with Co. More preferably, 25 percent or less of Fe is replaced with Co.

Element A is essential for hard magnetism, and is preferably added in an amount of at least 50 atomic percent. However, because an excessive addition causes difficulty in formation of the amorphous phase, the A content is preferably kept at 75 atomic percent or less.

Element D is essential for metal glass formation, and is preferably added in an amount of at least 5 atomic percent. However, because an addition of over 15 atomic percent causes a decrease in hard magnetism, the D content is preferably 15 kept at atomic percent or less.

The amorphous hard magnetic alloy set forth above may be produced as follows, for example; powder elements composing the alloy are prepared and mixed within the composition range set forth above; the mixture is melted in a crucible in an inert gas atmosphere such as gaseous argon to prepare a melt having a given composition; the alloy melt is cast in a mold, followed by cooling; and the resulting bulk amorphous hard magnetic cast alloy having a given size and shape is removed from the mold.

FIG. 1 is a cross-section view of an embodiment of a casting apparatus used in this case.

An alloy melt 3 within the composition range set forth above is placed into a cylindrical crucible 2 with a high frequency coil 1 for heating provided on its periphery, and a mold 4 such as of copper is placed under the crucible 2. A injection nozzle 2*a* is provided at the bottom of the crucible 2, and a cavity 5 for casting is formed inside the mold 4. An inert gas supplying unit (not shown in the figure) is provided above the crucible 2 to maintain an inert gas atmosphere in the crucible 2 and if necessary, to increase the internal pressure in the crucible 2 so as to inject the alloy melt from the injection nozzle 2*a* of the crucible 2 into the cavity 5 of the mold 4.

Figure 2:
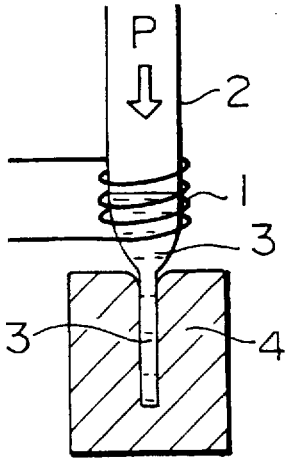
FIG. 2 is a cross-section view illustrating the casting of an amorphous hard magnetic cast alloy in accordance with the present invention into a mold.

The amorphous hard magnetic cast alloy in accordance with the present invention can be obtained using the apparatus set forth in FIG. 1 as follows; the alloy melt is cast by injection from the injection nozzle 2*a* into the cavity 5 of the mold 4 by means of a given pressure P of inert gas supplied inside the crucible 2 as shown in FIG. 2; and the alloy melt is cooled in the cavity 5.

The amorphous hard magnetic cast alloy produced by the method set forth above essentially consists of an amorphous phase and exhibits high coercive force.

Figure 3:
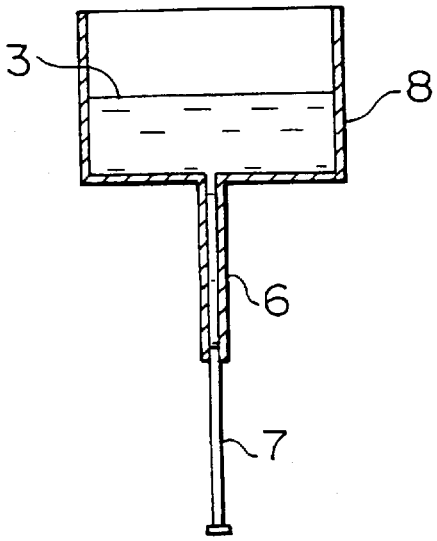
FIG. 3 is a cross-section view of another embodiment of a casting apparatus for producing an amorphous hard magnetic cast alloy in accordance with the present invention.

Although the apparatus set forth above includes a crucible 2 and the mold 4, the shapes and sizes are, of course, not limited. For example, as shown in FIG. 3, the amorphous hard magnetic cast alloy can be produced using a casting apparatus having a crucible-type melting section 8 provided with a cylinder 6 and a piston 7 in which the melt 3 is introduced into the cylinder 6 by pulling down on the piston 7, followed by cooling. Further, various conventional casting apparatuses can be used in the present invention. Widely used continuous casting apparatuses can also be applied to the present invention.

EXAMPLES

Nd powder, Fe powder and Al powder were mixed in various ratios within the composition of $Nd_{90-x}Fe_xAl_{10}$, each powder mixture was melted in the crucible of the casting apparatus set forth in FIG. 1, the melt was cast by injection into several copper molds each having a cylindrical cavity to prepare pin-shape samples. The resulting samples had a length of 50 mm and diameters of 1 to 10 mm. The injection pressure applied to the crucible was fixed at 0.05 MPa. For comparison, ribbons having a cross-section of 0.04 mm by 1 mm as comparative samples were prepared using the melts, each having the same composition as the sample in accordance with the present invention, by quenching using a prior art single-roller melt spinning method in a gaseous argon atmosphere.

Each sample was analyzed by transmission electron microscopy (TEM), scanning electron microscopy (SEM) and optical microscopy (OM). Before the optical microscopy, the sample was etched with a 0.5 vol % hydrofluoric acid solution at room temperature. Further, each sample was characterized by energy dispersive X-ray (EDX) spectroscopy, differential scanning calorimetry (DSC) and vibrating sample magnetometry (VSM).

Figure 4:
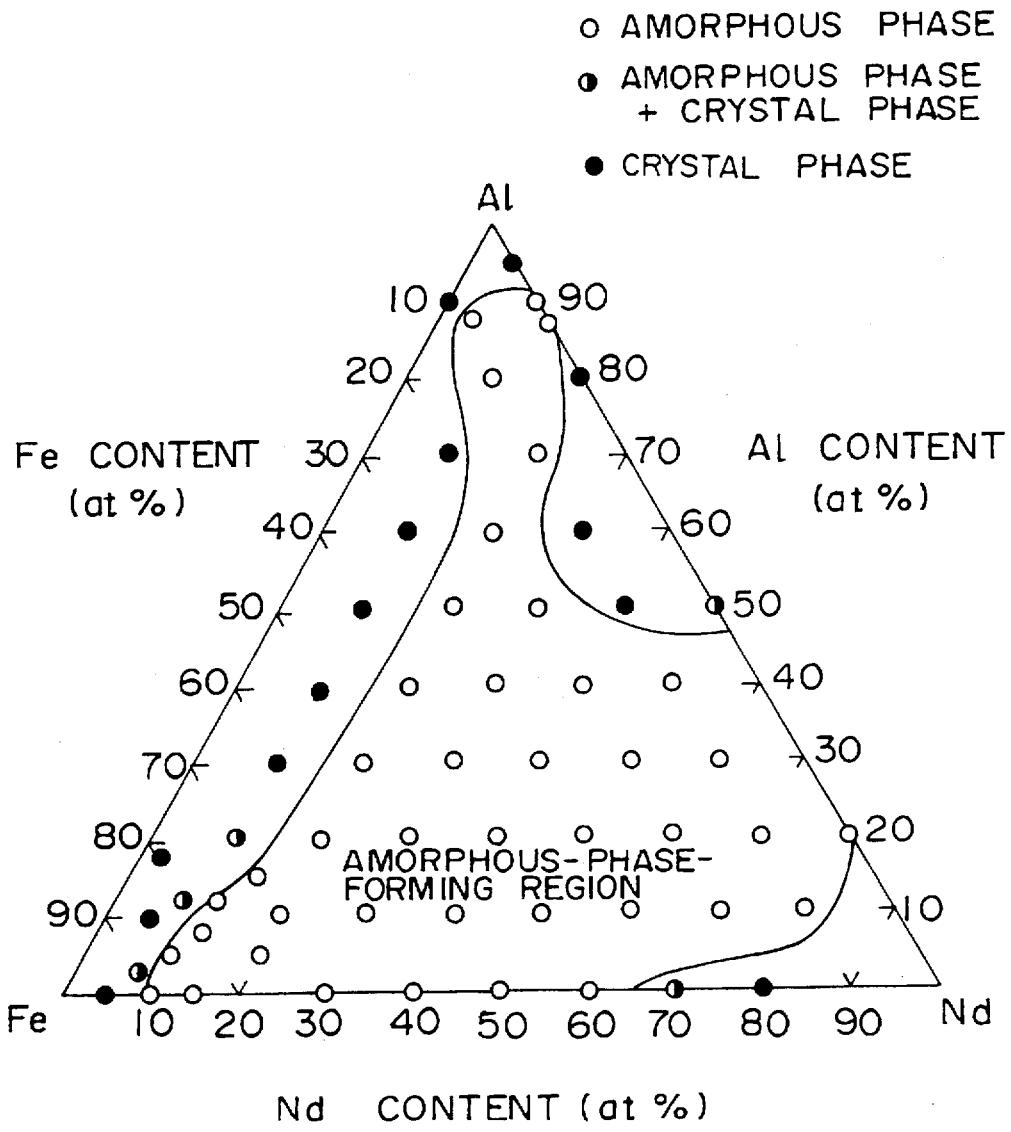
FIG. 4 is a ternary diagram illustrating a region of which an amorphous phase can be formed in a Nd—Fe—Al-based alloy.

FIG. 4 is a ternary diagram illustrating a region in which an amorphous phase can be formed in a Nd—Fe—Al-based alloy. Symbol ○ represents the region in which an amorphous phase can be formed, symbol ● represents the region in which a crystal phase can be formed, and symbol represents the region in which both the amorphous phase and crystal phase can be formed. FIG. 4 demonstrates that the amorphous phase can be formed in a wide region in which the Fe content ranges from 0 to 90 atomic percent and the Al content ranges from0 to 93 atomic percent.

Figure 5:
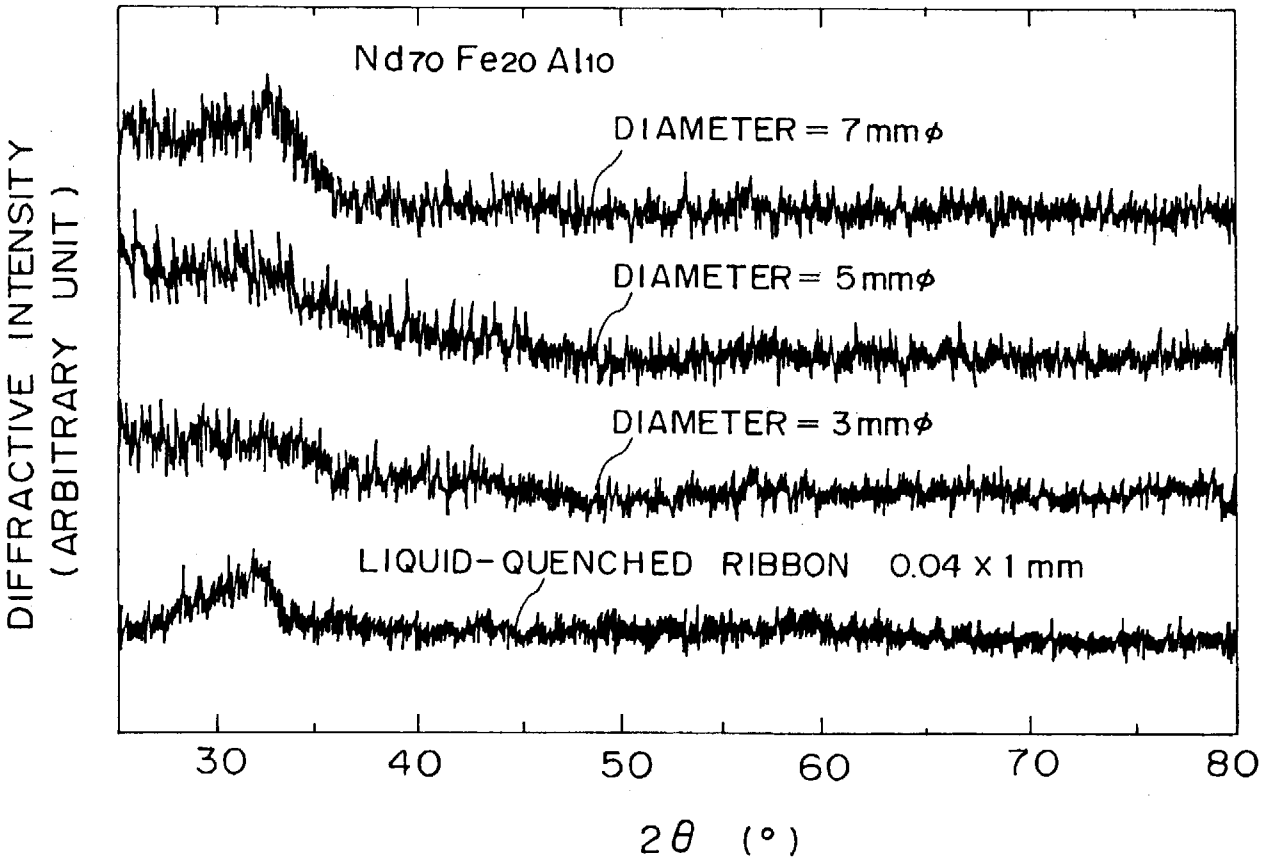
FIG. 5 consists of diagrams illustrating X-ray diffraction patterns for three column samples having diameters of 3 mm, 5 mm, and 7 mm, respectively, and a liquid-quenched ribbon which was produced by a single-roller melt spinning method and has a cross-section of 0.04 mm by 1 mm, in which the samples have a composition of $Nd_{70}Fe_{20}Al_{10}$.

FIG. 5 consists of diagrams illustrating X-ray diffraction patterns for three column samples having diameters of 3 mm, 5 mm and 7 mm, respectively, and a liquid-quenched ribbon, having a cross-section of 0.04 mm by 1 mm, which was produced using the single-roller melt spinning method set forth above, in which the samples have a composition of $Nd_{70}Fe_{20}Al_{10}$. All the patterns shown in FIG. 5 do not have distinct peaks as expected of the crystal phase, but have a broad blurry peak characteristic of the amorphous phase.

It was confirmed by microscopic observation that a sample having a composition of $Nd_{70}Fe_{20}Al_{10}$ and a diameter of 3 mm has a homogeneous plain microstructure, whereas a sample having a composition of $Nd_{60}Fe_{30}Al_{10}$ and a diameter of 3 mm has a microstructure in which needle-like microstructures of approximately 0.1 to 4 μm are partially formed in the plain microstructure.

Figure 6A:
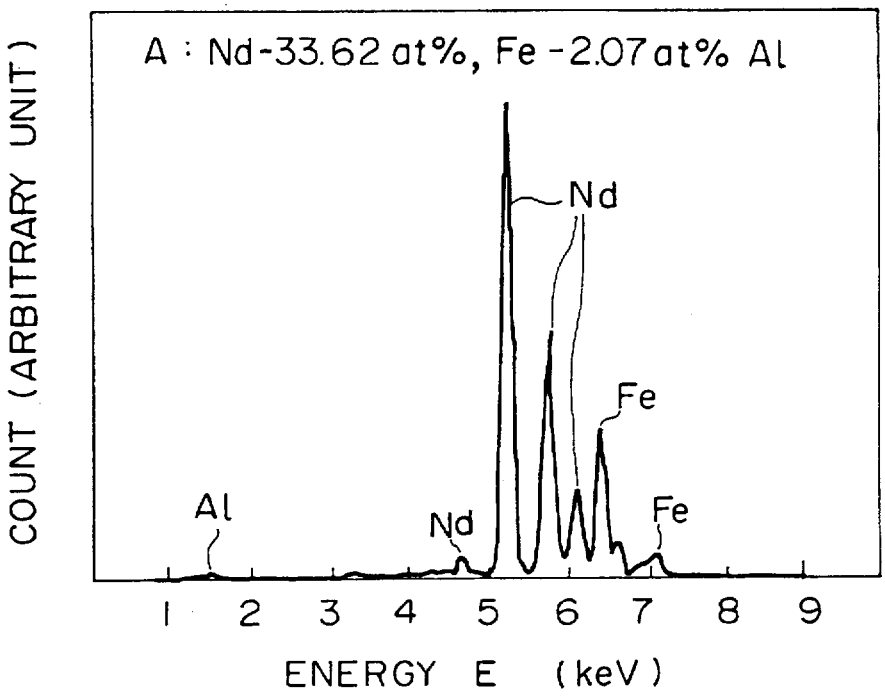
Figure 6B:
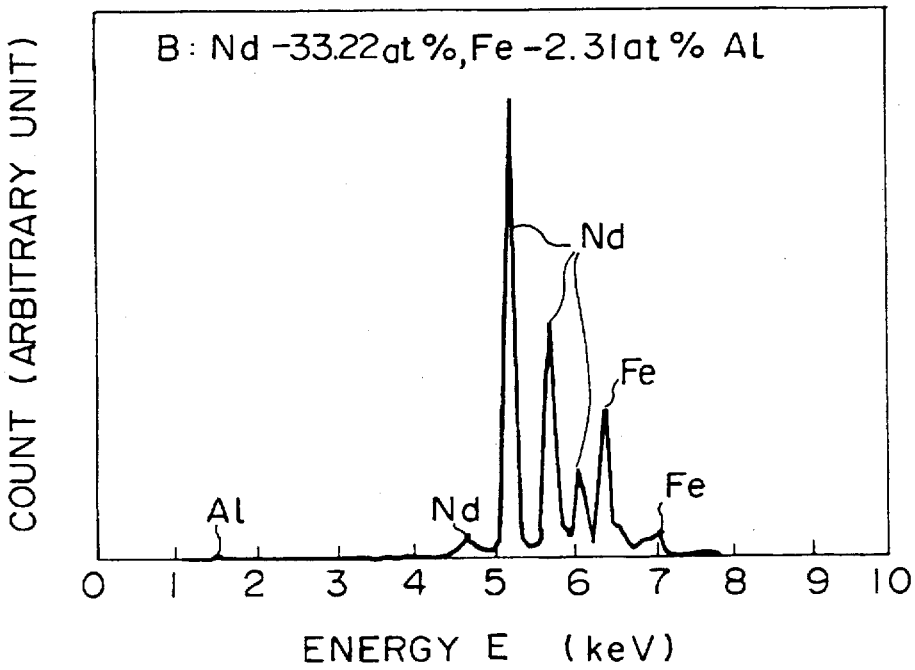

FIG. 6 shows diffraction patterns from the needle-like microstructure and the plain microstructure by energy dispersive X-ray (EDX) spectroscopy. In detail, FIG. 6A shows a diffraction pattern from a region of the plain microstructure not including needle-like microstructures, and FIG. 6B shows a diffraction pattern from a region including a needle-like microstructure. These diffraction patterns illustrate that there is no significant difference between both compositions. Thus, it has been concluded that both regions with the plain microstructure and the needle-like microstructure are of amorphous phase. The region with the needle-like microstructure probably exhibits random anisotropy which has developed from a random packing structure.

Wherein the random packing structure is a structure which can be achieved in amorphous alloys having lower critical cooling rates previously discovered by the present inventors. In the La—Al—TM-based, Mg—La—TM-based, Zr—Al—TM-based, Ti—Zr—Al—TM—Be-based and Ti—Zr—TM—Be-based alloys set forth above wherein La is a rare earth metal and TM is a transition metal, diameters of the three constituent atoms differ from each other by 10 to 12 percent. In other words, each of these alloys consists of a large atom, a medium atom and a small atom. Thus, a liquid of such an alloy would have a high atomic packing density which would form a high random anisotropic structure.

In amorphous alloys having random packing structures, solid/liquid interfacial energy increases to significantly reduce crystal nucleation in the liquid. Thus, an amorphous phase forms as the result of inhibited crystallization.

Random anisotropy means that the atomic arrangements between Ni and Fe and between Ni, Fe and Al are random over a long period, but ordered over a short period. As a result, magnetic anisotropy occurs due to the short period of order. Thus, the alloy in accordance with the present invention exhibits hard magnetism as set forth below.

Figure 7:
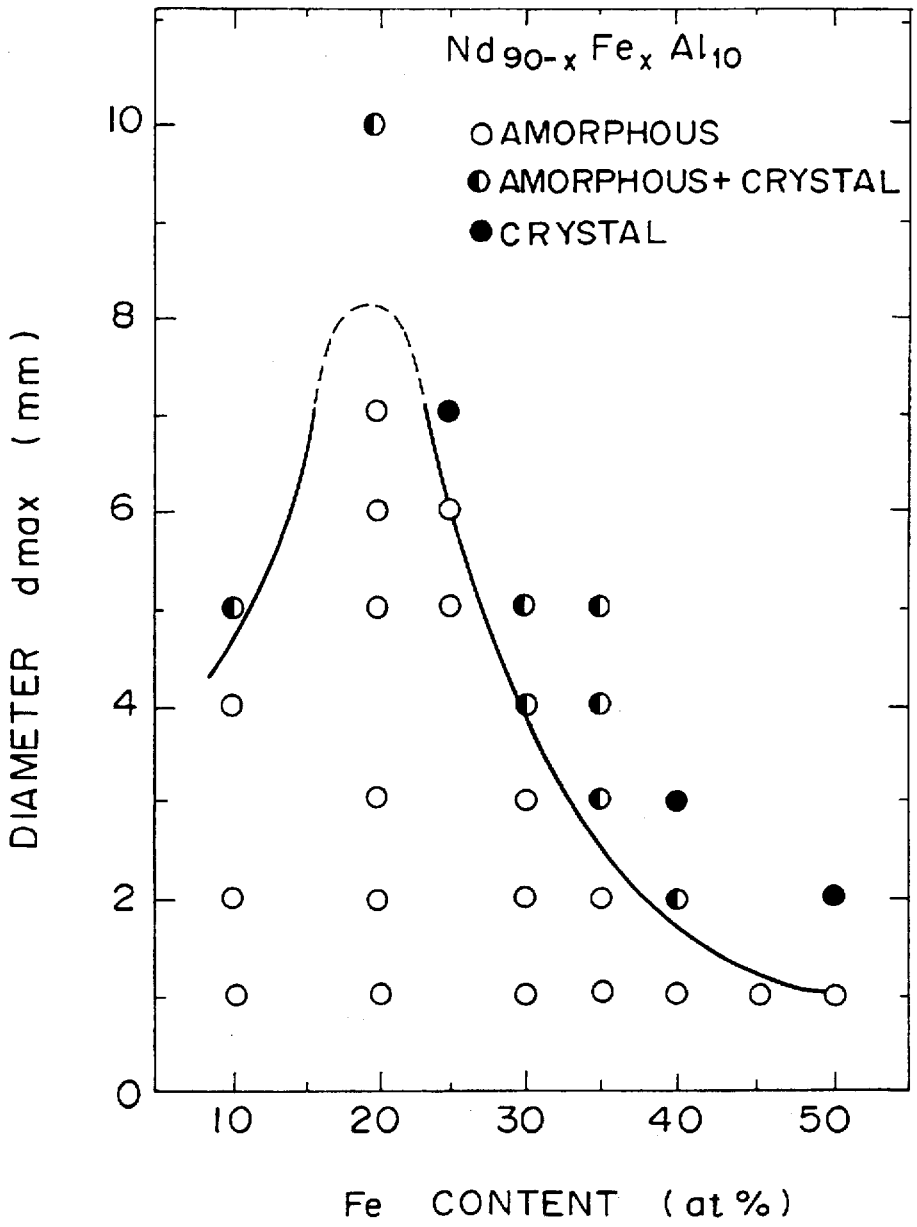
FIG. 7 is a graph illustrating microstructures of pin-type samples which are produced from $Nd_{90-x}Fe_xAl_{10}$-based alloys having different x values and diameters.

FIG. 7 is a graph illustrating microstructures of pin-type samples, each having a length of 50 mm. The samples were produced from $Nd_{90-x}Fe_xAl_{10}$-based alloy melts having different x values (i.e., 20, 30, 40 and 50 atomic percent), using an injection casting method using copper molds of different diameters (i.e., 1, 2, 3, 4, 5, 6, 7 and 10 mm). FIG. 7 illustrates that the injection casting method using copper molds can make an amorphous alloy having a maximum diameter of 7 mm when the Fe content is 20 atomic percent. At a diameter of 1 mm, amorphous alloys can be prepared with an Fe content widely ranging from 10 to 50 percent. A mixed phase alloy consisting of the crystal phase and amorphous phase can be prepared to a diameter of 10 mm when the Fe content is 20 atomic percent.

Figure 8:
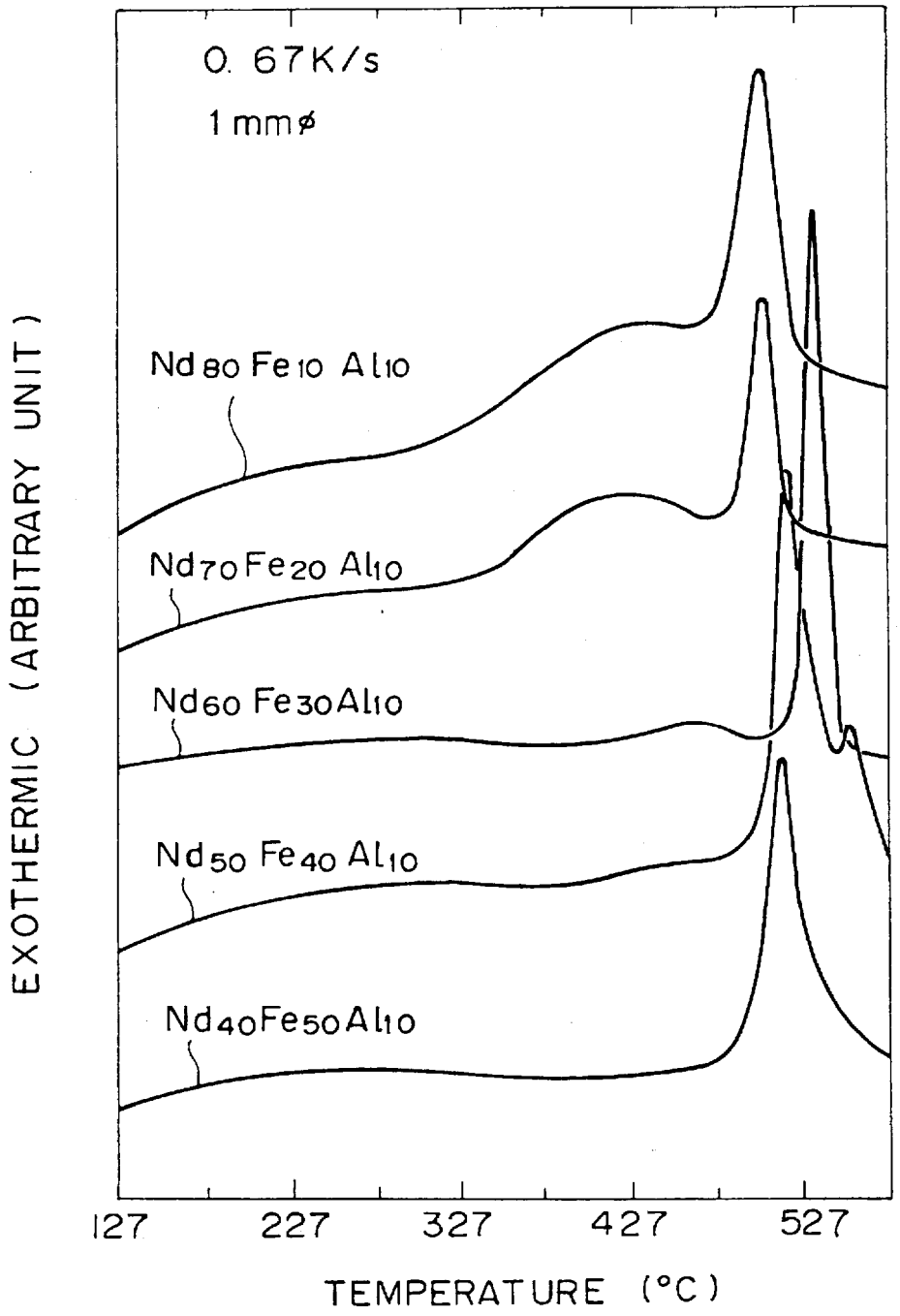
FIG. 8 consists of differential scanning calorimetric thermograms of alloys having different compositions in accordance with the present invention.

FIG. 8 shows differential scanning calorimetric (DSC) thermograms of alloys having a diameter of 1 mm with different compositions, i.e., $Nd_{80}Fe_{10}Al_{10}$, $Nd_{70}Fe_{20}Al_{10}$, $Nd_{60}Fe_{30}Al_{10}$, $Nd_{50}Fe_{40}Al_{10}$ and $Nd_{40}Fe_{50}Al_{10}$. All the DSC thermograms exhibit exothermic peaks due to crystallization at a temperature range of 480° to 550° C. At temperature ranges before each exothermic peak, a mild exothermic behavior can be observed, which will be discussed later.

Figure 9:
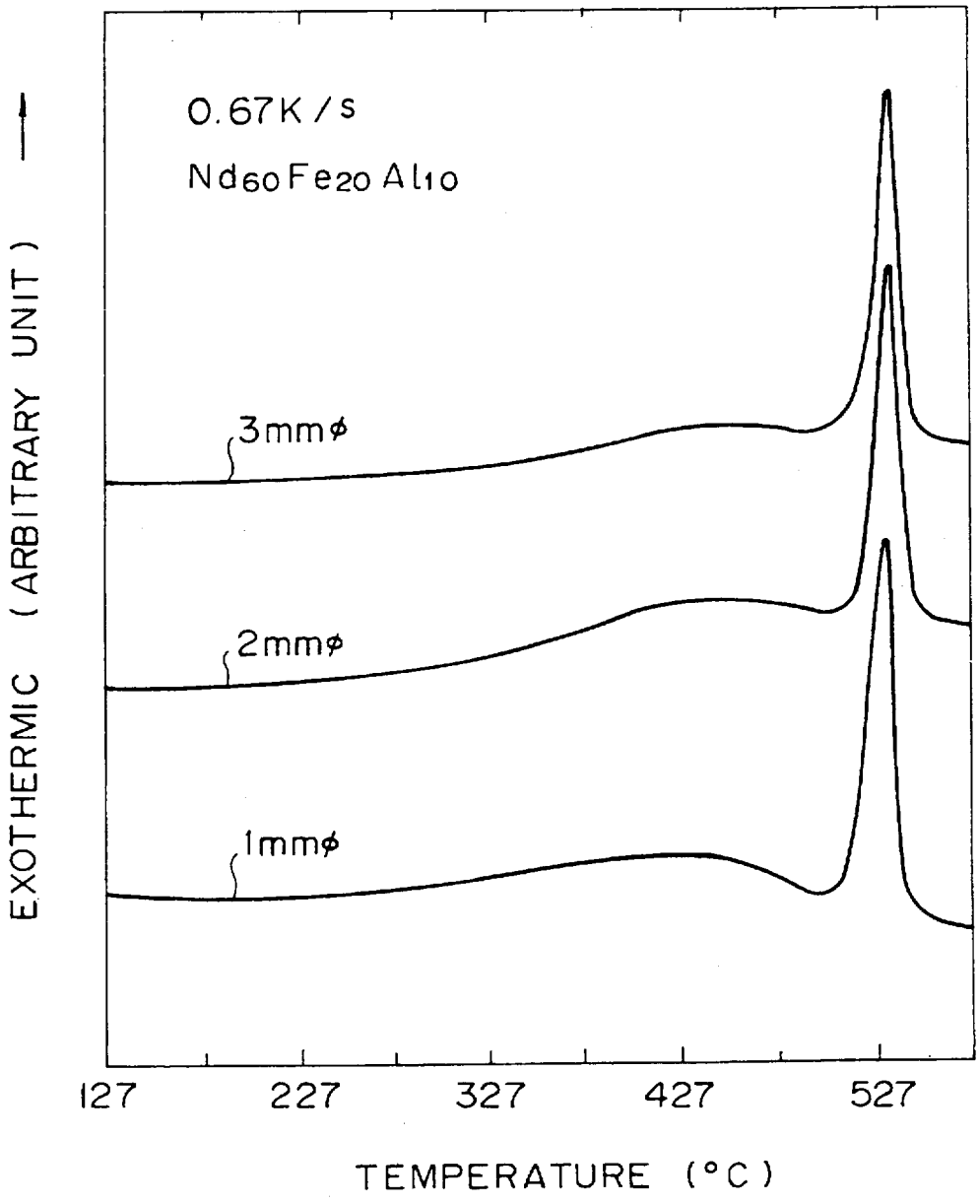
FIG. 9 consists of differential scanning calorimetric (DSC) thermograms of alloys having different diameters in accordance with the present invention.

FIG. 9 shows differential scanning calorimetric (DSC) thermograms of alloys having a composition of $Nd_{60}Fe_{30}Al_{10}$ with diameters of 1, 2 and 3 mm. These alloys exhibit thermograms similar to those in FIG. 8. In the alloy having a composition of $Nd_{60}Fe_{30}Al_{10}$, crystallization is observed after annealing in which the alloy is heated to 600° C. for 10 minutes and cooled slowly. The precipitate formed by crystallization consists of a hexagonal close-packed Nd phase, an isometric $Al_2Nd$ phase, and a tetragonal δ ($Nd_3Fe_{1-x}Al_x$) phase.

Figure 10:
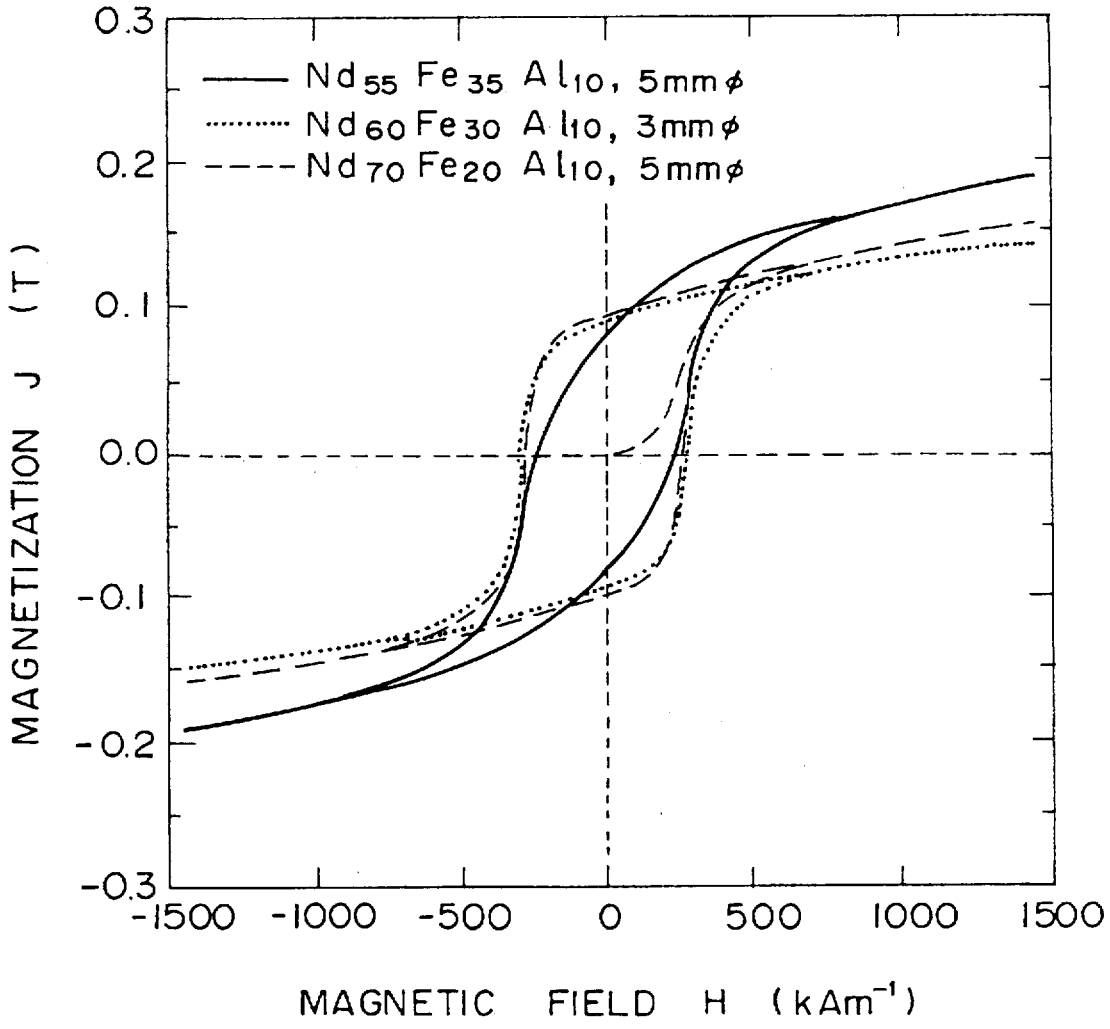
FIG. 10 is a graph illustrating magnetization curves of alloys having different compositions.
Figure 11A:
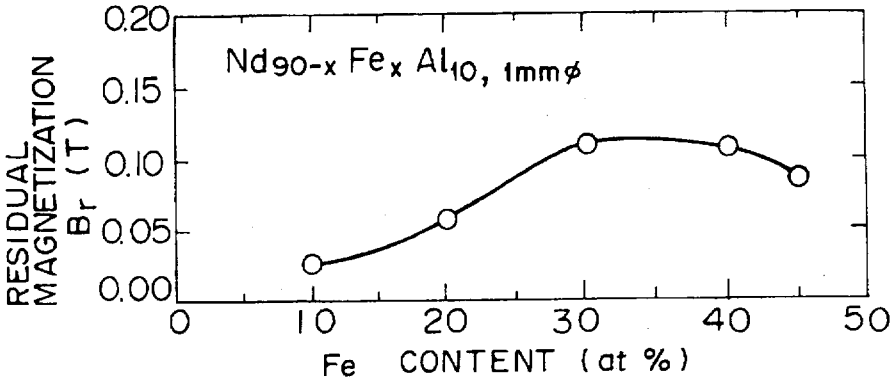
Figure 11B:
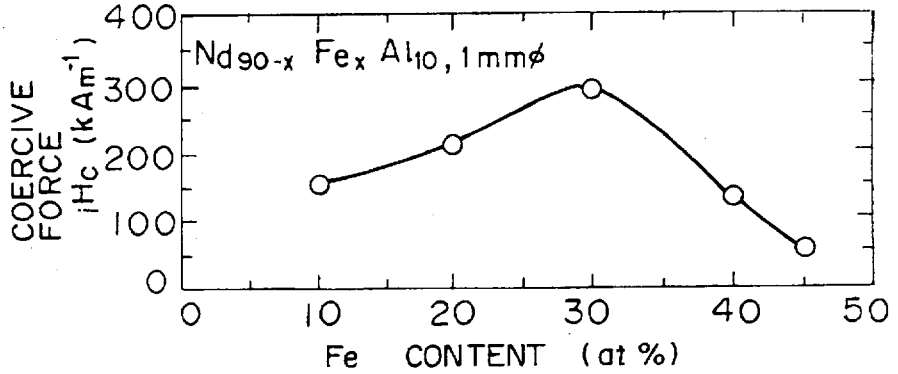
Figure 11C:
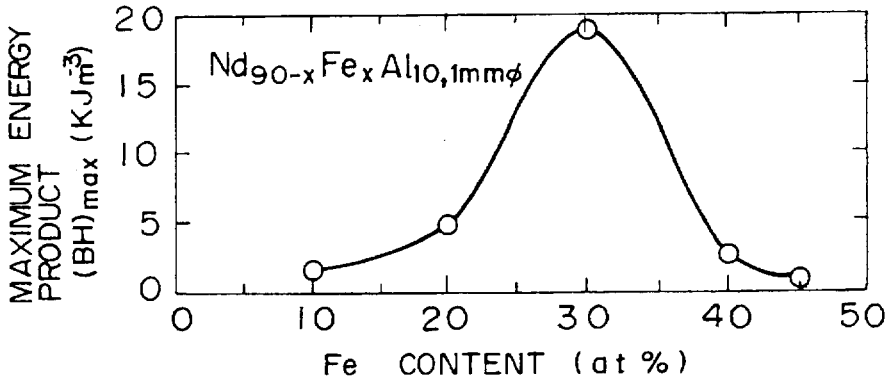
Figure 11D:
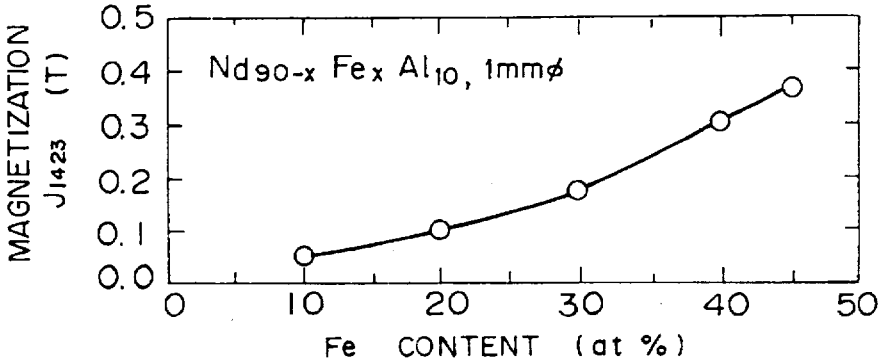

FIG. 10 is a graph illustrating a magnetization curve (J-H curve) of an alloy having a diameter of 5 mm, a length of 50 mm, and a composition of $Nd_{55}Fe_{35}Al_{10}$; an alloy having a diameter of 3 mm, a length of 50 mm, and a composition of $Nd_{60}Fe_{30}Al_{10}$; and an alloy having a diameter of 5 mm, a length of 50 mm, and a composition of $Nd_{70}Fe_{20}Al_{10}$. These alloys were made by the injection casting method using the same copper molds under the same condition set forth above. Since all the alloys exhibit magnetic hysteresis curves illustrating high coercive forces, these alloys are considered to be hard magnetic alloys.

FIG. 11 shows the dependence on the Fe content of magnetic properties in an alloy having a composition of $Nd_{90-x}Fe_xAl_{10}$. FIG. 11A is a graph illustrating the correlation between the Fe content and residual magnetization, FIG. 11B is a graph illustrating the correlation between the Fe content and coercive force, FIG. 11C is a graph illustrating the correlation between the Fe content and maximum energy product, and FIG. 11D is a graph illustrating the correlation between the Fe content and magnetization. These results demonstrate that the Fe content preferably ranges from 20 to 40 atomic percent within the range of 10 to 45 atomic percent. The Fe content more preferably ranges from 25 to 35 atomic percent to achieve a higher maximum energy product.

Figure 12:
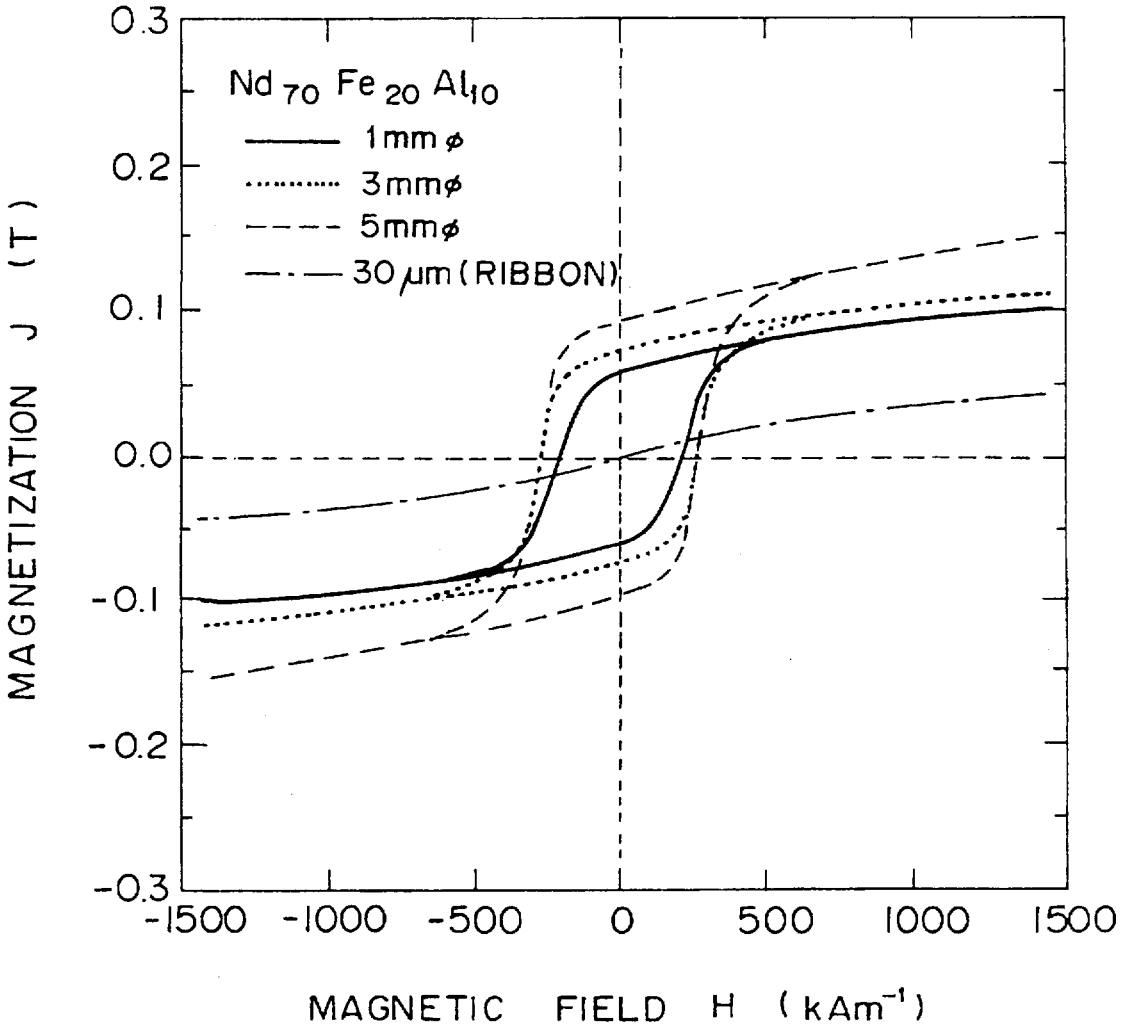
FIG. 12 is a graph of magnetic field vs magnetization of alloys having different diameters.

FIG. 12 is a graph illustrating magnetization curves of alloys having a composition of $Nd_{70}Fe_{20}Al_{10}$ and different diameters (i.e., 1, 3 and 5 mm), and a magnetization curve of a liquid quenched ribbon which has the same composition as above and was prepared using the single-roller melt spinning method. All the samples having different diameters in accordance with the present invention exhibit magnetic hysteresis curves inherent to hard magnetic materials, whereas the liquid quenched ribbon does not exhibit a magnetic hysteresis curve, but exhibit a curve similar to that of a paramagnetic material.

Figure 13:
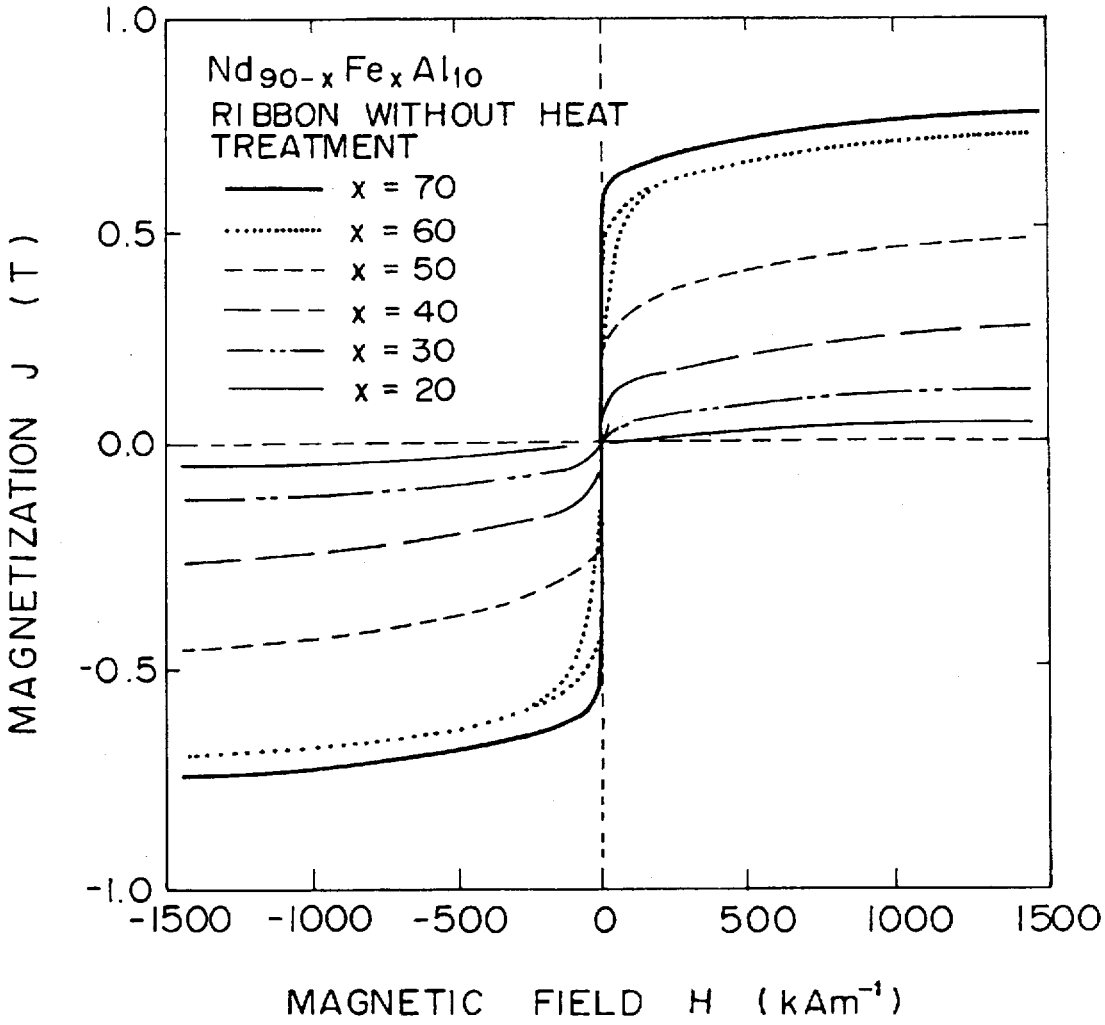
FIG. 13 is a graph of magnetic field vs magnetization of ribbons produced by a quenching method and having different compositions.

FIG. 13 is a graph illustrating magnetization curves of $Nd_{90-x}Fe_xAl_{10}$ ribbon alloys which were produced using a liquid quenching method and have different x values, i.e., 20, 30, 40, 50, 60, and 70. None of these alloys exhibit magnetization curves inherent to hard magnetic materials. Thus, a ribbon exhibiting hard magnetism cannot be produced using liquid quenching methods.

Figure 14A:
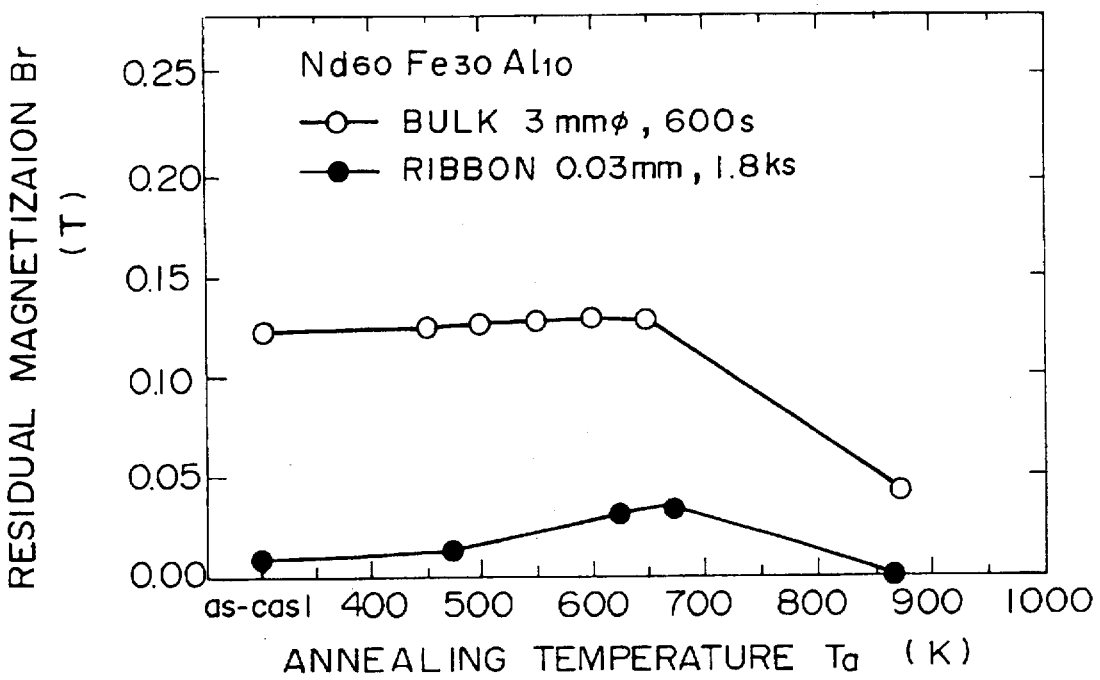
Figure 14B:
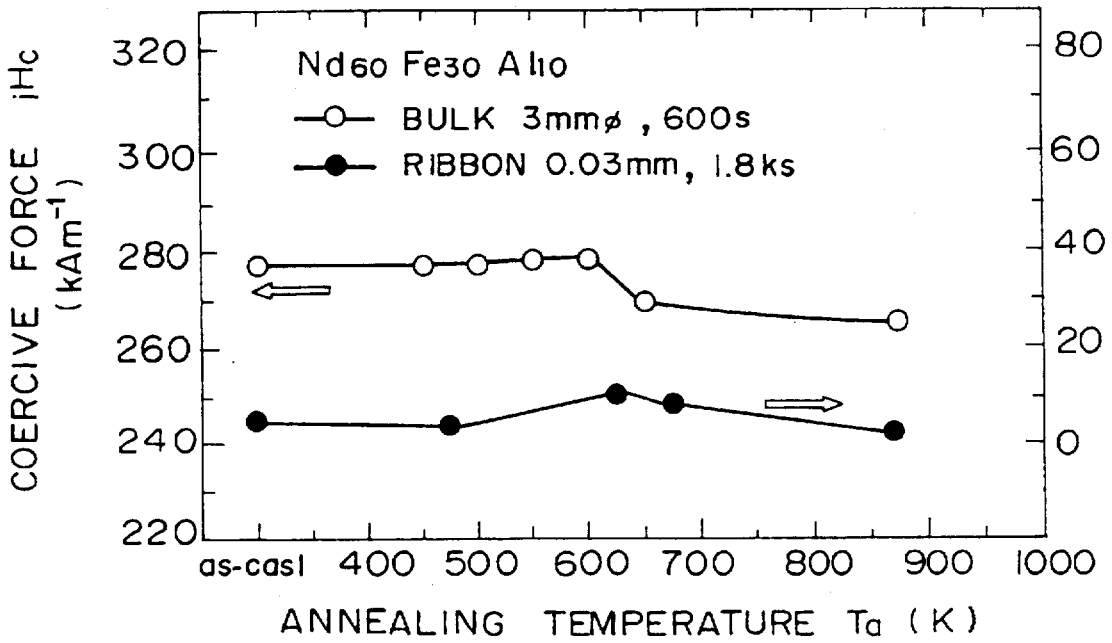

FIG. 14 shows the correlations between the annealing temperature and residual magnetization and between the annealing temperature and coercive force of an alloy having a composition of $Nd_{60}Fe_{30}Al_{10}$ and a diameter of 3 mm, and of a ribbon alloy having the same composition. The results shown in FIG. 14 also illustrate that the alloy in accordance with the present invention is a hard magnetic material. When this alloy is annealed at 327° C. (600K) for 10 minutes, the residual magnetization decreases to 0.04 T and the coercive force decreases to 265 kA/m, probably due to a mixture of Nd, A12 Nd, and α phases caused by the transition from the amorphous phase to a crystal phase.

Figure 15:
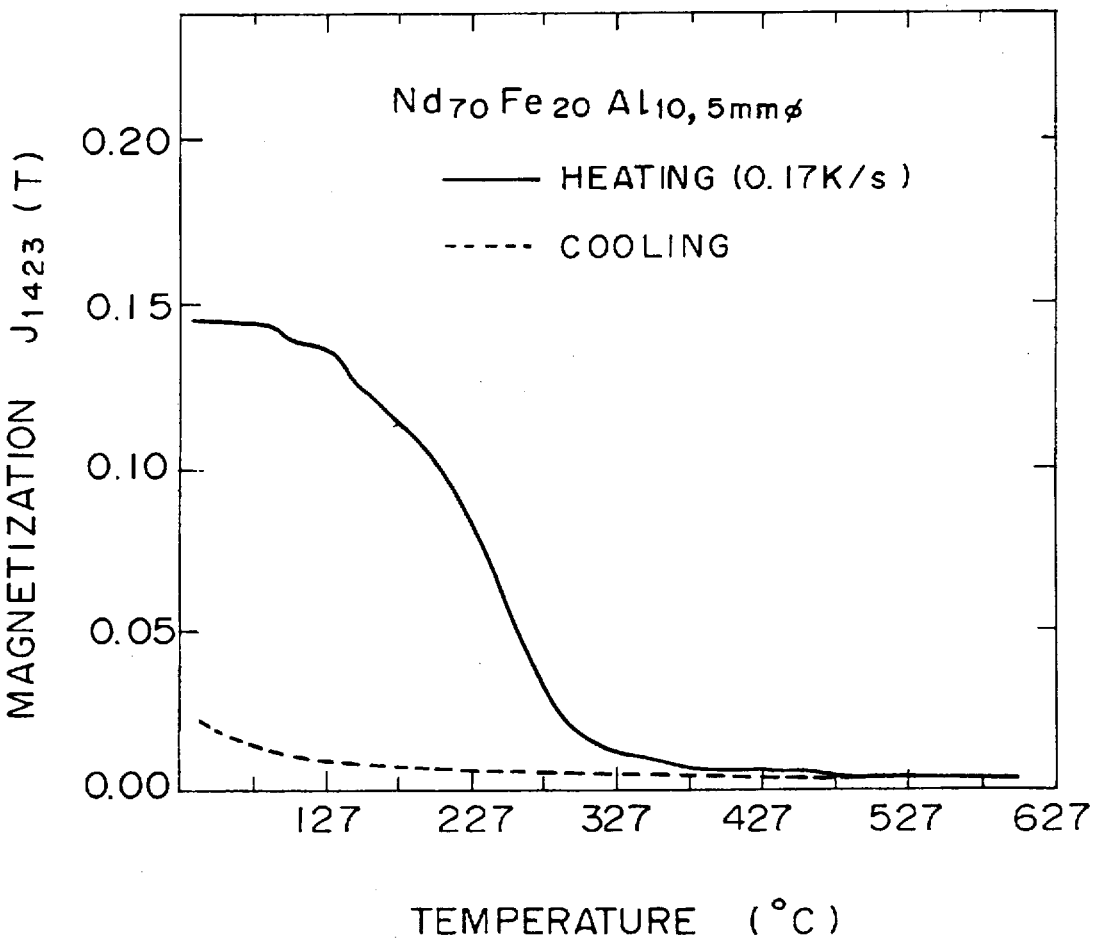
FIG. 15 is a graph illustrating the heating temperature vs magnetization of an alloy in accordance with the present invention.

FIG. 15 is a graph illustrating the correlation between the heating temperature and residual magnetization of an alloy which has a composition of Nd70Fe20Al10 and a diameter of 5 mm, on which a 1,432 kA/m magnetic field was applied, followed by heating and cooling of the alloy. This alloy is ferromagnetic and has a Curie temperature at approximately 327° C. (600K). The residual magnetization and coercive force of the cast alloy are 0.122 T and 277 kA/m, respectively. After annealing at 327° C. (600K) for 10 minutes, the residual magnetization and coercive force of the cast alloy are 0.128 T and 277 kA/m, respectively.

Figure 16:
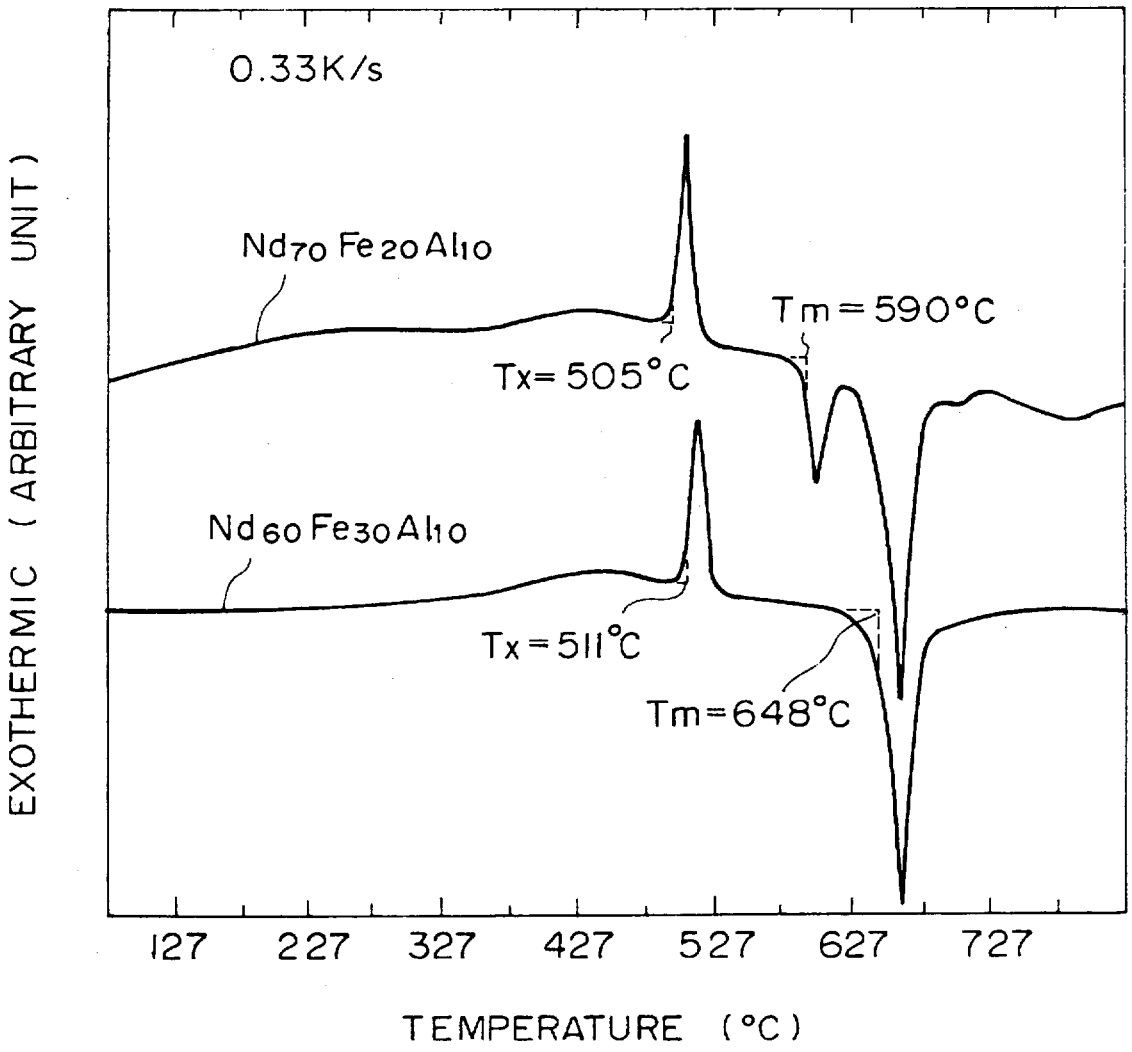
FIG. 16 consists of DSC thermograms of alloys in accordance with the present invention; p FIG. 17 consists of DSC thermograms of ZrAlNi-based and ZrAlCu-based alloys.

FIG. 16 shows DSC thermograms of two alloys having compositions of $Nd_{70}Fe_{20}Al_{10}$ and $Nd_{60}Fe_{30}Al_{10}$, respectively, measured at a heating rate of 0.33 K/s. FIG. 16 demonstrates that the alloy having a composition of $Nd_{70}Fe_{20}Al_{10}$ has a melting point Tm of 590° C. (863K) and a crystallization starting temperature of 505° C. (778K), and the alloy having a composition of $Nd_{60}Fe_{30}Al_{10}$ has a melting point Tm of 648° C. and a crystallization starting temperature of 511° C.

As shown on DSC thermograms in FIGS. 16 and 9, a glass transition temperature and a supercooled region are not observed in the alloys in accordance with the present invention. On the other hand, in each of ZrAlNi-based and ZrAlCu-based amorphous alloys which have a lower critical cooling rate, a glass transition temperature Tg and a supercooled region are observed, as shown in FIG. 17, at a temperature range lower than the crystallization starting temperature Tx.

Figure 17:
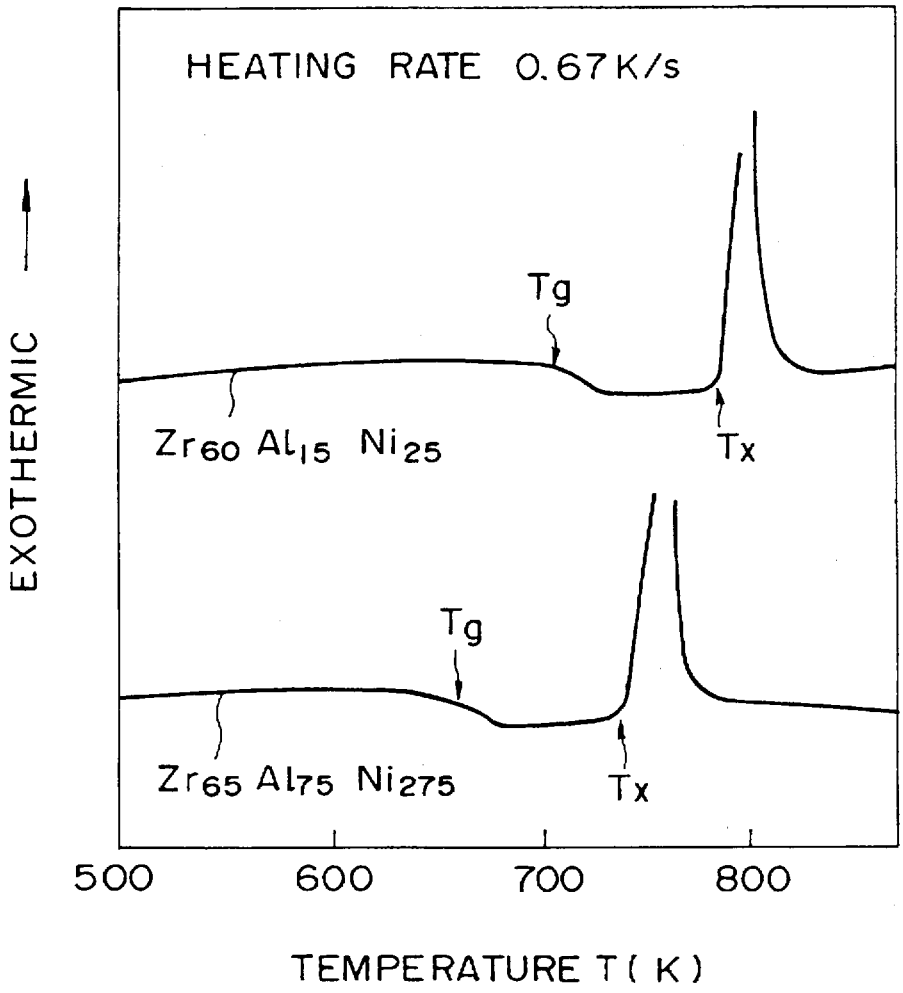

Because the alloy in accordance with the present invention exhibits quite a different thermal behavior to the alloys shown in FIG. 17, amorphous phases in the former and latter alloys probably formed by different mechanisms. The alloy in accordance with the present invention has a relatively high reduced ratio Tx/Tm (the ratio of the crystallization starting temperature to the melting point) of 0.9 and a small temperature interval between the crystallization starting temperature and the melting point of 85° C. The high formability of the amorphous phase in the alloy in accordance with the present invention can probably be achieved by the high reduced ratio Tx/Tm and small temperature interval ΔT (=Tx−Tm).

As shown in FIGS. 10 and 11, the alloy having a composition of Nd70Fe20Al10 is ferromagnetic and has a Curie point of approximately 327° C. (600k), and the residual magnetization and coercive force of the cast alloy are 0.122 T and 277 kA/m.

The hard magnetism of the alloy in accordance with the present invention is probably caused by homogeneous growth of ferromagnetic clusters having a large random anisotropy.

Figure 18:
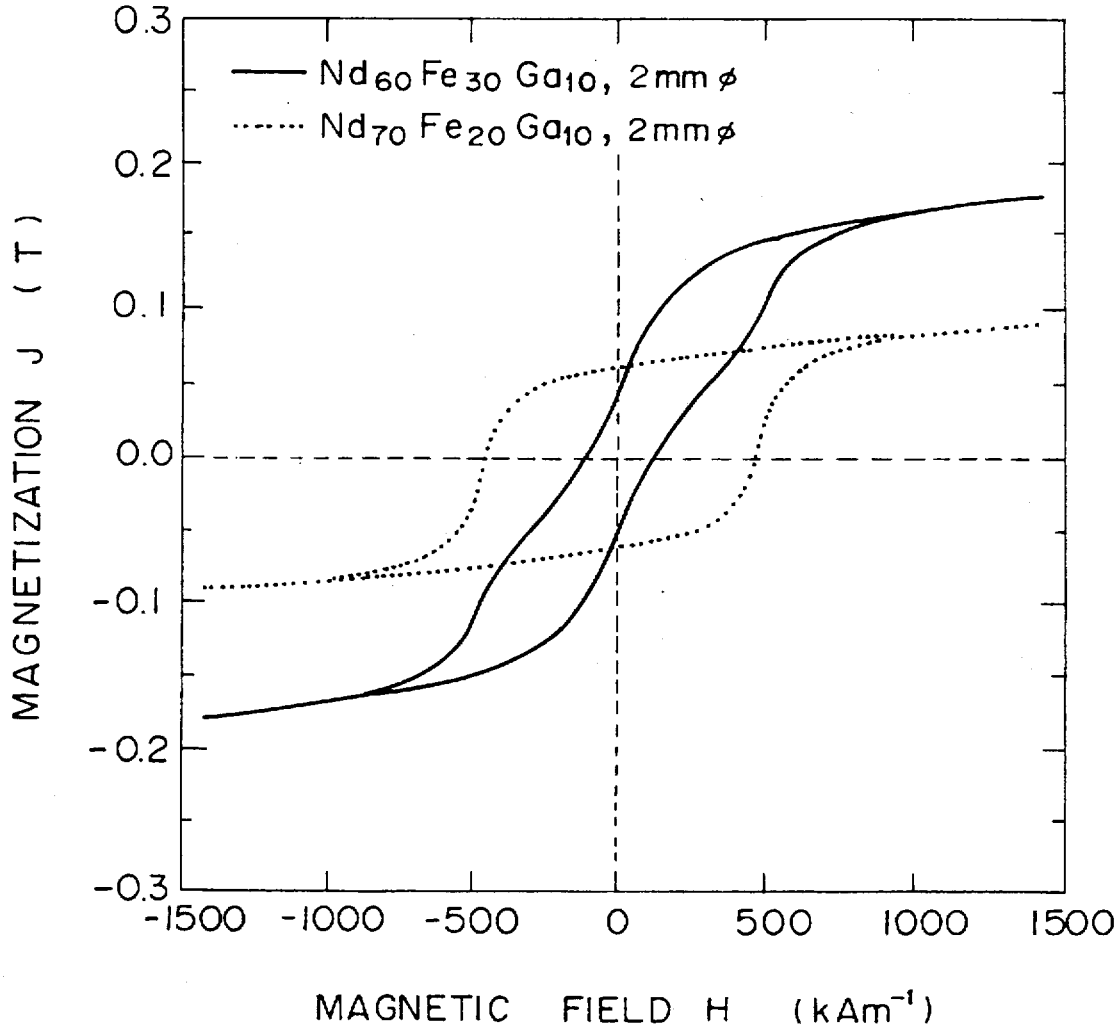
FIG. 18 is a graph illustrating magnetic field vs magnetization of NdFeGa-based alloys in accordance with the present invention.

FIG. 18 is a graph illustrating magnetization curves of NdFeGa-based alloys in which Ga was added instead of Al in the NdFeAl-based alloy. Both $Nd_{60}Fe_{30}Ga_{10}$ and $Nd_{70}Fe_{20}Ga_{10}$ alloys exhibit magnetic hysteresis curves showing hard magnetism.

Figure 19:
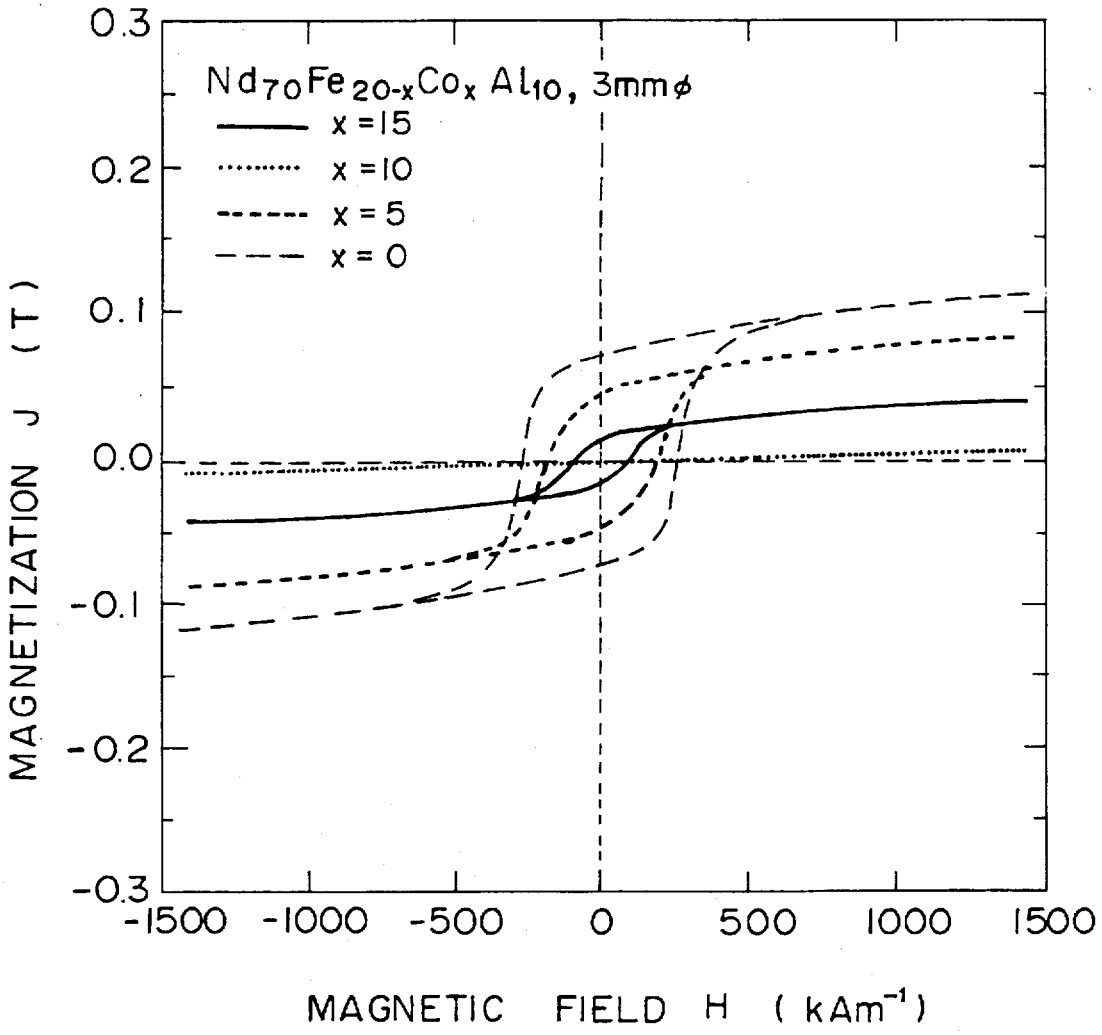
FIG. 19 is a graph illustrating magnetic field vs magnetization of $Nd_{70}Fe_{20-x}Co_xAl_{10}$ alloys having different Co contents in accordance with the present invention.

FIG. 19 is a graph illustrating magnetization curves of $Nd_{70}Fe_{20-x}Co_xAl_{10}$ alloys which have a diameter of 30 mm and different Co contents (i.e., 0, 5, 10 and 15 atomic percent). Fe in the NdFeAl-based alloy was partially replaced with Co in this case. Excellent hard magnetism can be achieved up to x=5 atomic percent or a replacement rate of 25%.

Figure 20:
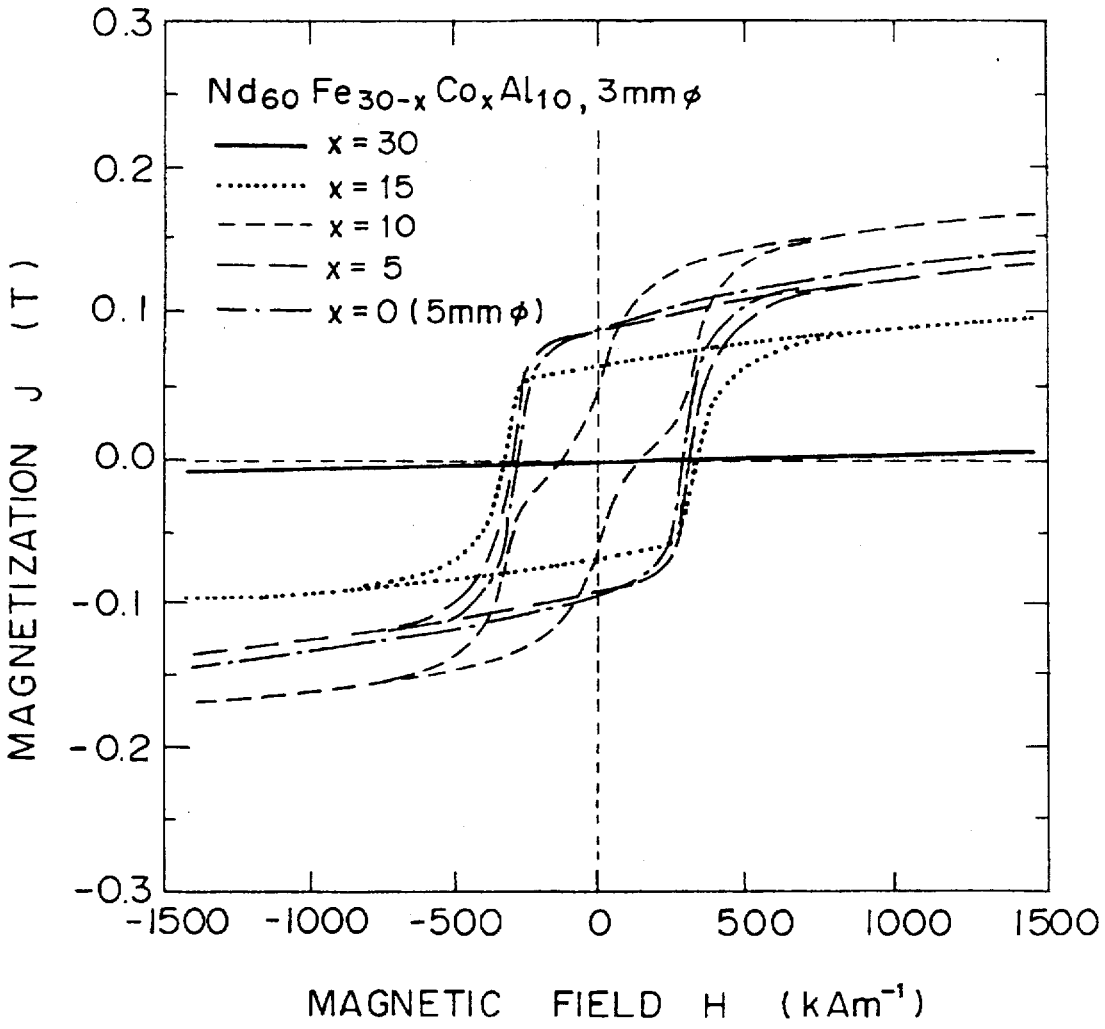
FIG. 20 is a graph illustrating magnetic field vs magnetization of $Nd_{60}Fe_{30-x}Co_xAl_{10}$ alloys having different Co contents in accordance with the present invention.

FIG. 20 is a graph illustrating magnetization curves of $Nd_{60}Fe_{30-x}Co_xAl_{10}$ alloys which have a diameter of 50 mm and different Co contents (i.e., 0, 5, 10, 15 and 30 atomic percent). Excellent hard magnetism can be achieved up to x=15 atomic percent or a replacement rate of 50%.

As shown in FIGS. 19 and 20, 50% of Fe can be replaced with Co for $Nd_{60}Fe_{30-x}Co_xAl_{10}$-based alloys, and the alloy in which 25% of Fe was replaced with Co exhibits the more preferable hard magnetism.

As set forth above, an amorphous hard magnetic alloy in accordance with the present invention has the following general formula:

$$A_x—(Fe_{1-a}Co_a)_y—D_z$$

wherein A represents at least one element selected from the group consisting of Nd, Sm, Pr and Pm; D represents at least one element selected from the group consisting of Al, Ga, and Ge; suffixes x, y, and z satisfy $50 \leqq x \leqq 75$, $10 \leqq y \leqq 45$, and $5 \leqq z \leqq 15$ atomic percent, and suffix a satisfies $0 \leqq a \leqq 0.5$. Thus, the alloy has a low critical cooling rate and an amorphous alloy can be readily produced using a casting method. The resulting alloy exhibits high hard magnetism, coercive force, and maximum magnetic energy.

The maximum magnetic energy of the amorphous hard magnetic alloy can be further enhanced by limiting the Fe content to $25 \leqq y \leqq 35$ atomic percent.

Thus, a hard magnetic alloy which can be readily changed into an amorphous state is obtainable in the present invention.

Further, a hard magnetic casting alloy essentially consisting of an amorphous phase can be readily produced by casting the alloy melt of the composition set forth above into a mold. Since a cast alloy having a desirable shape can be obtained by changing the shape of the mold, a thick cast alloy having a thickness of several mm and having hard magnetism can be readily produced.

What is claimed is:

1. An amorphous hard magnetic alloy having the following general formula:

$$A_x—(Fe_{1-a}Co_a)_y—D_z$$

wherein A represents at least one element selected from the group consisting of Nd, Sm, Pr and Pm; D represents at least one element selected from the group consisting of Al, Ga, and Ge; suffixes x, y, and z satisfy $50 \leqq x \leqq 75$, $10 \leqq y \leqq 45$, and $5 \leqq z \leqq 15$ atomic percent, and suffix a satisfies $5 \leqq a \leqq 0.5$.

2. An amorphous hard magnetic alloy according to claim 1, wherein random anisotropic ferromagnetic clusters form in the alloy.

3. An amorphous hard magnetic alloy according to claim 1, wherein the suffix y satisfies $25 \leqq y \leqq 35$ atomic percent.

4. An amorphous hard magnetic alloy according to claim 3, wherein random anisotropic ferromagnetic clusters form in the alloy.

5. An amorphous hard magnetic casting alloy comprising a composition of the following general formula:

$$A_x—(Fe_{1-a}Co_a)_y—D_z$$

wherein A represents at least one element selected from the group consisting of Nd, Sm, Pr and Pm; D represents at least one element selected from the group consisting of Al, Ga, and Ge; suffixes x, y, and z satisfy $50 \leqq x \leqq 75$, $10 \leqq y \leqq 45$, and $5 \leqq z \leqq 15$ atomic percent, and suffix a satisfies $0 \leqq a \leqq 0.5$.

6. An amorphous hard magnetic casting alloy according to claim 5, wherein random anisotropic ferromagnetic clusters form in the alloy.

7. An amorphous hard magnetic casting alloy according to claim 5, wherein the suffix y satisfies $25 \leqq y35$ atomic percent.

8. An amorphous hard magnetic casting alloy according to claim 7, wherein random anisotropic ferromagnetic clusters form in the alloy.

9. A method for producing an amorphous hard magnetic casting alloy comprising: casting a melt of an amorphous hard magnetic alloy comprising a composition of the following formula into a mold followed by cooling:

$$A_x—(Fe_{1-a}Co_a)_y—D_z$$

wherein A represents at least one element selected from the group consisting of Nd, Sm, Pr, and Pm; D represents at least one element selected from the group consisting of Al, Ga, and Ge; suffixes x, y, and z satisfy $50 \leqq x \leqq 75$, $10 \leqq y \leqq 45$, and $5 \leqq z \leqq 15$, and suffix a satisfies $0 \leqq a \leqq 0.5$ atomic percent.

10. A method for producing an amorphous hard magnetic casting alloy according to claim 9, wherein the suffix y satisfies $25 \leqq y \leqq 35$ atomic percent.

11. A method for producing an amorphous hard magnetic casting alloy according to claim 10, wherein the amorphous hard magnetic casting alloy is produced by injection casting in which said melt reserved in a crucible is cast from an injection nozzle into a cavity of said mold by applying pressure onto said melt.

12. A method for producing an amorphous hard magnetic casting alloy according to claim 11, wherein suffix y satisfies $25 \leqq y \leqq 35$ atomic percent.

* * * * *

UNITED STATES PATENT AND TRADEMARK OFFICE

CERTIFICATE OF CORRECTION

PATENT NO. : 5,725,684

DATED : March 10, 1998

INVENTOR(S) : Akihisa Inoue et al.

It is certified that error appears in the above-indentified patent and that said Letters Patent is hereby corrected as shown below:

In the Title Page, item: [54] and;

In column 1, line 2, replace "CAST" with --CASTING--.

In the Claims

In claim 1, line 10 (last line of claim), replace "$5 \leqq a \leqq 0.5$" with --$0 \leqq a \leqq 0.5$--.

In claim 7, line 2, replace "$25 \leqq y35$" with $25 \leqq y \leqq 35$--.

Signed and Sealed this

Seventh Day of September, 1999

*Attest:*

Q. TODD DICKINSON

*Attesting Officer*

*Acting Commissioner of Patents and Trademarks*